US011712732B2

(12) United States Patent
Bouygues et al.

(10) Patent No.: US 11,712,732 B2
(45) Date of Patent: Aug. 1, 2023

(54) PUNCH TOOL FOR SHEET METAL OR A MULTI-LAYER ASSEMBLY OF SHEET METAL AND CORRESPONDING PUNCHING METHOD

(71) Applicant: GYS, Saint-Berthevin (FR)

(72) Inventors: Bruno Bouygues, Paris (FR); Arnaud Frison, Chatillon-sur-Colmont (FR)

(73) Assignee: GYS, Saint-Berthevin (FR)

( * ) Notice: Subject to any disclaimer, the term of this patent is extended or adjusted under 35 U.S.C. 154(b) by 0 days.

(21) Appl. No.: 17/365,354

(22) Filed: Jul. 1, 2021

(65) Prior Publication Data

US 2022/0001435 A1 Jan. 6, 2022

(30) Foreign Application Priority Data

Jul. 3, 2020 (FR) ..... 2007062

(51) Int. Cl.
*B21D 28/26* (2006.01)

(52) U.S. Cl.
CPC ..... *B21D 28/26* (2013.01)

(58) Field of Classification Search
CPC ..... B21D 28/26; B21D 28/34; B21D 35/007
USPC ..... 83/55
See application file for complete search history.

(56) References Cited

U.S. PATENT DOCUMENTS 6,092,964 A * 7/2000 El Dessouky ..... B23B 47/284 408/112
2013/0263433 A1* 10/2013 Stoian ..... B21J 15/28 29/243.53
2014/0217227 A1* 8/2014 Kilibarda ..... B21J 15/025 242/555.3
2014/0217272 A1* 8/2014 Ramer ..... F28D 15/02 250/238
2017/0087736 A1* 3/2017 Buchholz ..... B26F 1/14
(Continued)

FOREIGN PATENT DOCUMENTS

DE 102017203228 A1 * 8/2018 ..... B21D 28/002
DE 102017203228 A1 8/2018
(Continued)

OTHER PUBLICATIONS

French Search Report and Written Opinion dated Feb. 22, 2021 for corresponding French Application No. 2007062, filed Jul. 3, 2020.
(Continued)

*Primary Examiner* — Nhat Chieu Q Do
(74) *Attorney, Agent, or Firm* — David D. Brush; Westman, Champlin & Koehler, P.A.

(57) ABSTRACT

A punching tool to make holes in a part made of a sheet metal or a multi-layer assembly of sheet metals, for example a part for the body of a vehicle. The punching tool includes a punch holder holding a one-piece cutting punch and a punch die arranged in front of the punch holder, the punch holder being designed to move the punch toward the die from a rest position to a work position in which the cutting punch cuts out a hole in the part placed between the punch holder and the die. The cutting punch is removably housed in a cavity formed in the punch holder so that, when the punch holder withdraws from the work position to the rest position, the cutting punch separates from the punch holder and remains in the hole pierced in the part.

6 Claims, 6 Drawing Sheets

(56) References Cited

U.S. PATENT DOCUMENTS

| | | | | |
|---|---|---|---|---|
| 2019/0262893 | A1* | 8/2019 | Huff | B21J 15/28 |
| 2019/0381554 | A1* | 12/2019 | Geiger | B21D 28/34 |

FOREIGN PATENT DOCUMENTS

| | | | |
|---|---|---|---|
| EP | 2886218 | A1 | 6/2015 |
| JP | H106296 | A | 1/1998 |
| JP | 2017001065 | A | 1/2017 |
| WO | 2018157983 | A1 | 9/2018 |

OTHER PUBLICATIONS

English translation of the Written Opinion dated Feb. 22, 2021 for corresponding French Application No. 2007062, filed Jul. 3, 2020.

* cited by examiner

PUNCH TOOL FOR SHEET METAL OR A MULTI-LAYER ASSEMBLY OF SHEET METAL AND CORRESPONDING PUNCHING METHOD

TECHNICAL FIELD

The present disclosure relates to the field of working on materials, such as sheet metal. More particularly, the disclosure refers to the field of punching sheet metal, more specifically the field of punch tooling.

A exemplary embodiment is used, in particular, in the automotive field, but also in any industrial field requiring that perforations be made in sheet metals. For example, an embodiment may be useful in the area of auto body repair.

BACKGROUND

Punch tooling is used in industry in order to make perforations in sheet metals, for example in high-strength sheet metal parts.

Punching is a shearing along a closed shaped performed by a punch working against a die. It is used to make holes and to cut out complex-shaped pieces which are not rectangular at times and are therefore difficult or even impossible to do by shearing.

Cutting out vehicle body parts by punching is a technique that has been in use for many years. Indeed, in comparison to a drilling method, punching proves to be faster to do, which is therefore a savings in precious time in the cutting out of such sheet metals.

In the automotive field in particular, most sheet metals that undergo punching are sheet metals made of high-strength (HS) steel, referred to as hard sheet metals, which make it possible to reduce the weight of the vehicle while improving the safety of occupants in the event of an impact. They typically have a mechanical strength of between 200 and 1600 MPa.

As a result, there is substantial wear of the punches used to make perforations by punching these sheet metals, and so they need to be replaced regularly, which is time-consuming.

It has been proposed a sheet metal punching device including a die and a punch with a movable punching rod on which is installed a punching ring which makes it possible to better control the shape of the hole being made. Once the hole has been made, the washer falls on the die side together with the cut-off made at the time of cut-out, and the punching rod passes back through the perforated hole in the opposite direction so as to be removed therefrom.

This prior art device is not satisfactory because the ring, which has a small diameter, is difficult to handle and to place on the punching rod. In addition, it is difficult to retrieve once it has fallen on the other side of the perforated sheet metal.

Furthermore, the ring is used only once because it wears out very quickly.

There is therefore a need to improve the existing technique so as to provide a punching device and method making it possible to perforate high-strength sheet metals without damaging the perforated holes and to quickly replace worn out punches after the punching operation.

SUMMARY

An exemplary embodiment of the present disclosure satisfies this need by proposing a punching tool intended to make holes in a part made of a sheet metal or a multi-layer assembly of sheet metals, for example a body part of a vehicle, said punching tool comprising a punch holder holding a one-piece cutting punch and a punch die arranged in front of said punch holder, said punch holder being designed to move said cutting punch toward said die from a rest position to a work position in which said cutting punch cuts out a hole in said part placed between said punch holder and said die, said cutting punch being removably housed in a cavity formed in said punch holder so that, when said punch holder withdraws from the work position to the rest position, said cutting punch separates from said punch holder and remains lodged in said hole cut out in said part.

An exemplary embodiment therefore proposes to implement a one-piece cutting punch removably installed on a punch holder.

Only the one-piece cutting punch is intended to pierce the sheet metal, the punch holder which carries the one-piece cutting punch not being intended to pass at least partially through the hole cut by the cutting punch and then to pass back through the hole in the opposite direction. The punch holder is therefore not configured to pierce the sheet but only to carry and move the one-piece cutting punch, without engaging in the hole pierced by the cutting punch.

The cutting punch, which is made of a single piece, is mounted on the punch holder in a removable way, without screwing, so that it initially cuts the sheet metal, then it is disconnected from the punch holder when the latter is withdrawn after cutting, the cutting punch then remaining lodged in the drilled hole. Therefore, but also on account of its dimensions and the material of which it is made, such a punch is very easy to position on the punch holder and easy to remove from the sheet metal used to make the part to be perforated. In addition, it is easy to find if it falls on the other side of the sheet metal.

Thanks to its greater bulkiness, the punch is more robust than the rings of the prior art and can be reused numerous times.

According to a particular aspect of the disclosure, said cutting punch has an undercut and a tip, opposite said undercut, said tip being configured so as to slide into said cavity, said tip having a shape that complements that of said cavity.

According to a particular aspect of the disclosure, said tip of said cutting punch has a substantially cylindrical shape.

The disclosure also relates to a method for punching a part made of a sheet metal or a multi-layer assembly of sheet metals by means of a punching tool as described above, said method comprising the following series of steps:

- positioning the part to be perforated in position between the punch holder and the die of said punching tool arranged one in front of the other;
- punching said part only by the one-piece cutting punch placed on the punch holder by moving the punch holder from the rest position to the work position thereof;
- removing said punch holder by moving the punch holder from the work position to the rest position thereof;
- releasing said part in which the cutting punch is housed; removing said cutting punch from said part by pushing said cutting punch through the part.

According to a particular aspect of the disclosure, the method comprises a prior step in which said cutting punch is placed in position in said cavity of said punch holder.

According to a particular aspect of the disclosure, the step in which said cutting punch is removed from said part is done by pushing said cutting punch through the part in the perforating direction of said hole.

According to a particular aspect of the disclosure, the method comprises a prior step in which said part to undergo punching is placed against said die.

BRIEF DESCRIPTION OF THE DRAWINGS

Other objectives, features, and advantages of will become clearer from a reading of the following description, given as a simple and non-limiting illustrative example in reference to the figures, in which.

DETAILED DESCRIPTION OF ILLUSTRATIVE EMBODIMENTS

Figure 1:
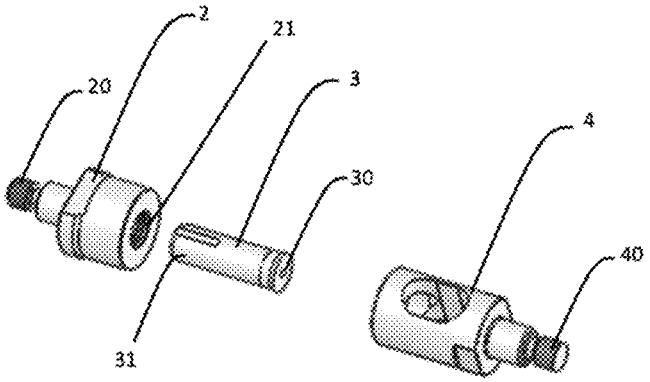
FIG. 1 is a perspective view of a punching tool according to one embodiment of the disclosure.

The general principle of an exemplary embodiment of the disclosure is based on the implementation of a punching tool intended to make holes in the surface of a part made of a single piece of sheet metal or a multi-layer assembly of sheet metals (that is, an assembly of two or more thicknesses of sheet metals, the sheet metals all being made of the same material, such as steel, or the sheet metals being made of different materials (at least one sheet metal made of steel and at least one sheet metal made of aluminium, for example). Such a part, for example, is a body part of a vehicle. The punching tool comprises a punch holder that holds a one-piece cutting punch removably housed in a cavity formed in said punch holder. In this way, when the cutting punch holder moves from its work position, i.e. the position for perforating the part, to its rest position, the cutting punch separates from the punch holder without any action by the operator, and remains with the punched part so that it can then be pushed through the perforated hole. Since the cutting punch is larger than the ring of the prior art, installation of the punch on the punch holder for the subsequent punching operation is thus facilitated.

In the example described below, the punching tool is of the C-shaped goose neck type. However, it could have some other shape.

As shown in FIGS. 1 to 6, this punching tool comprises a punch holder 2 holding a one-piece cutting punch 3, and a punch die 4 placed in front of the punch holder 2.

Here, the punch die 4 is in the shape of a hollow cylindrical body with a bore (otherwise referred to as an orifice or evacuation channel) allowing a punching cut-out to pass after perforation of the part T consisting of a sheet metal or a multi-layer assembly of sheet metals. These sheet metals can be made of very hard UHEL ("ultra-high elastic limit") steel, for example, such as boron steel.

The two parts, that is, the punch holder 2 on the one hand, and the punch die 4 on the other hand, are made by means of a goose neck 9. Here, this goose neck 9 forms a C-shaped frame allowing the two parts to be held in place in relation to each other.

So as to be held on the goose neck 9, the punch holder 2, which is generally cylindrical, comprises a first holding component 20 capable of cooperating with a first recess implemented at one end of the goose neck.

Likewise, and so as to be held on the goose neck 9, the punch die 4 comprises a second holding component 40 capable of cooperating with a second recess implemented at the opposite end of the goose neck.

FIG. 1 shows the punch holder 2, the punch die 4, and the punch 3 when they are disassembled from the goose neck 9. All these parts are cylindrical.

The punch holder 2 is movably mounted and is designed to move from a rest position to a work position so as to move the punch 3 to the die 4 along an axis of movement A, until the punch 3 enters the sheet metal part T arranged between the punch holder 2 and the die 4 so as to cut out a hole therein.

Upon cutting out the sheet metal part T, the punch 3 pushes a cut-out of the sheet metal part, corresponding to the material removed by perforating, into the bore of the punch die 4.

The movement of the punch holder 2 and of the punch 3 can, depending on the embodiments, be driven by means of an actuator (not shown in the figures).

Here, this one-piece punch 3 is implemented in the form of a rod having a diameter of, for example, 6 to 10 mm, which can be designed to be made of high-strength steel.

The punch 3 has an undercut 30 allowing the perforation of the sheet metal part T to be made in the work position.

According to an exemplary embodiment of the disclosure, the punch 3 is removably housed in a cavity 21 formed in the punch holder 2 in such a way that, when the punch holder 2 moves from its work position to its rest position, the punch 3 separates from the punch holder 2 and remains with the sheet metal part T (the cutting punch 3 remains lodged in the pierced hole).

On account of its dimensions and the material of which it is made, the punch 3 is reusable and easier to retrieve after the punching operation.

In other words, the punch 3 is placed in the cavity 21 of the punch holder, and this without clamping or screwing, so that the punch 3 is free to move in the translation direction along an axis of movement of the punch holder 2 corresponding to the axis of movement A.

As shown in FIG. 1, this cavity 21 is made opposite the holding component 20 of the punch holder 2.

There must be enough play between the cavity 21 and the punch 3 so that the punch separates from the punch holder at the moment when the punch holder withdraws once the punching has been completed. This play must not be too greater, either, to prevent the punch from falling from the punch holder before the punching is done and to ensure effective punching of the sheet metal being perforated. The outer diameter of the cutting punch 3 may thus be slightly smaller than the inner diameter of the cavity 21.

In one embodiment, the cutting punch 3 may be retained in the cavity 21 of the punch holder 2 by friction. In other words, the punch 3 is retained in the cavity 21 by rubbing. This frictional force is chosen so that when the cutting punch 3 has drilled the hole and is located in the hole, it can disengage from the punch holder 2 when the punch holder 2 withdraws by moving in the opposite direction of the drilling direction. In particular, in this embodiment, the punch 3 has a tip 31, opposite the undercut 30, which is configured to slide into the cavity 21.

So as to facilitate this sliding, and in the illustrated embodiment, the tip 31 and the cavity 21 have a respective shape that is substantially complementary.

Here, the tip 31 of the punch 3, and therefore the cavity 21 of the punch holder 2, have a substantially circular cross-section, with the two cross-sections being complementary.

However, in other embodiments, a cavity and a punch tip having a different cross-section, for example a triangular, square, or more generally polygonal shape, could be used, with the respective cross-sections of the cavity and the punch tip being complementary.

An embodiment of punching method 100 for punching a part T made of a single sheet metal or a plurality of layers of sheet metal by means of a punching tool will now be presented in reference to FIGS. 2 to 7.

Figure 2:
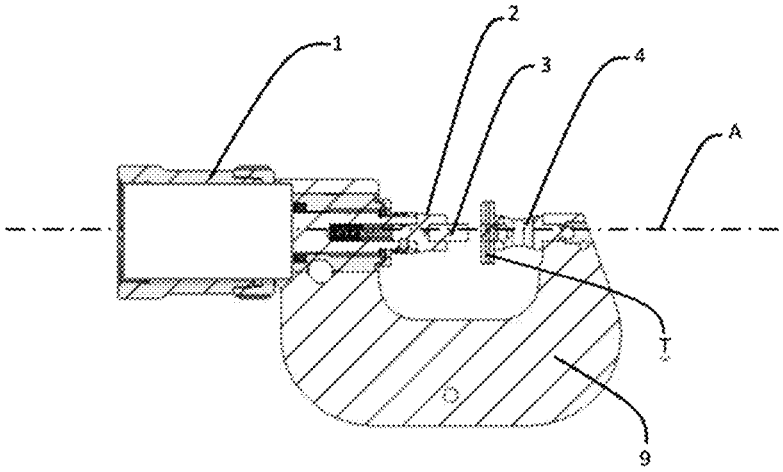
FIG. 2 is a cross-sectional view of a punching tool placed on a goose neck according to a method for implementing an exemplary embodiment, illustrating the step for putting the sheet metal part to be perforated in position.
Figure 7:
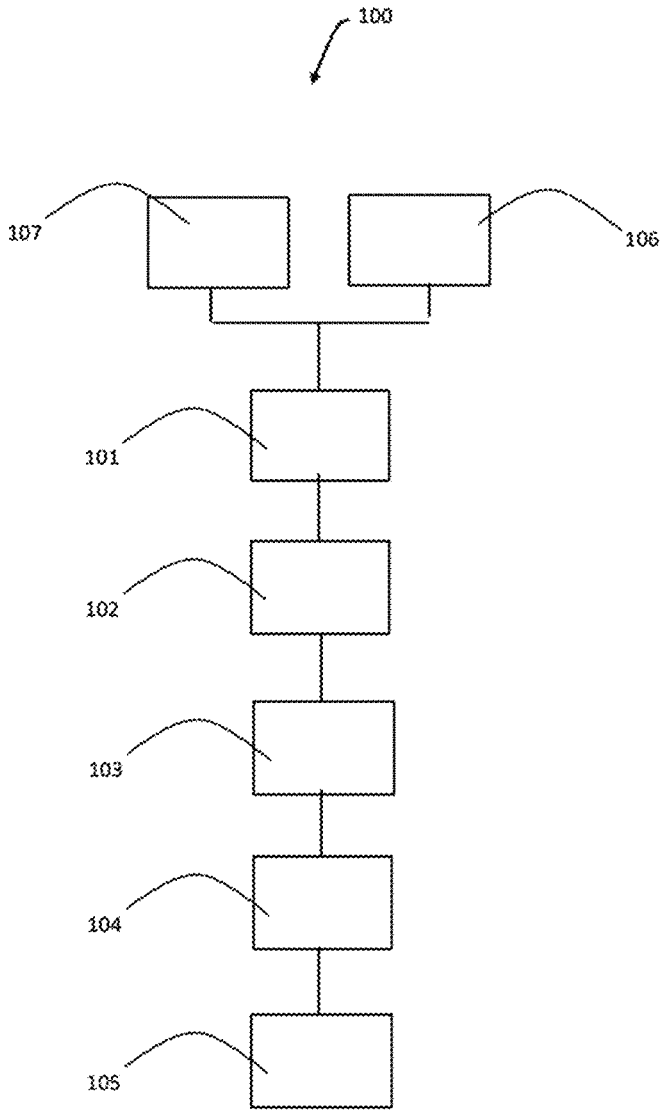
FIG. 7 is a diagram showing the various steps of the method for punching a sheet metal part according to one embodiment of the disclosure.

According to the presented disclosure, and as shown in FIG. 7, this method comprises the following series of steps:

- positioning 101 of the part to be perforated T between the punch holder 2 and the die 4 of the punching tool, which are located one in front of the other;
- punching 102 of the part T by the cutting punch only so as to perforate a hole by movement of the punch holder 2 from its rest position to its work position (from left to right, in this case) in a first direction;
- withdrawal 103 of the punch holder 2 by movement of the latter from its work position to its rest position (from right to left), in a second direction opposite said first direction, the punch 3 separating from the punch holder and remaining in the hole of the punched part T;
- releasing 104 of the punched part Tin which the punch 3 is held;
- withdrawal 105 of the punch 3 from the punched part T by pushing the punch 3 through the part T FIG. 2 shows a cross-section of the punching tool after the positioning step 101.

As shown in this position, the punch holder 2 is in the rest position at a distance from the part T, which is in turn resting against the punch die 4. The punch holder 2, the punch 3, and the punch die 4 are aligned along the axis of movement A.

Figure 3:
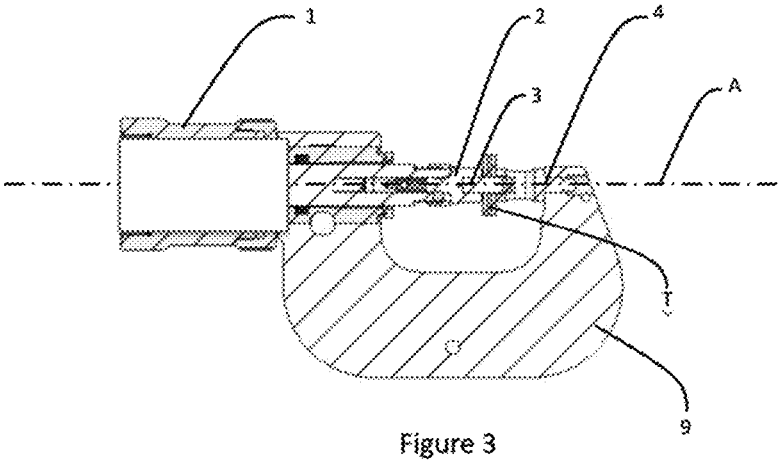
FIG. 3 is a cross-sectional view of the punching tool in FIG. 2, illustrating the step for punching the sheet metal part.

FIG. 3 illustrates a cross-section of the punching tool during the punching step 102 by movement of the punch holder 2 from its rest position to its work position along the axis of movement A.

As shown, in this position the punch holder 2 is in the work position and the punch 3 is in contact with the part T which is perforated at the location of the point of contact between the punch 3 and the part T along the axis of movement A. In this position, the sheet metal cut-out (not shown) has fallen into the punch die. The punch 3 is therefore housed in the hole which has just been made in the part T.

It is to be noted that the punch holder 2 does not pass through the part T, even partially, and therefore does not engage in the hole drilled by the punch 3.

Figure 4:
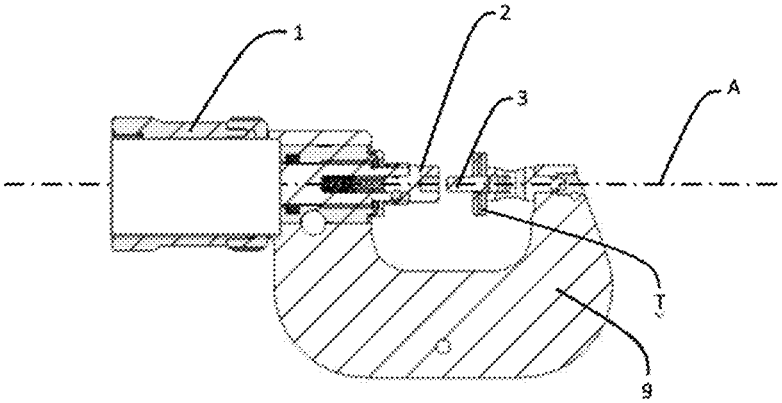
FIG. 4 is a cross-sectional view of the preceding punching tool, illustrating the step for removing the punch holder.

FIG. 4 illustrates a cross-section of the punching tool during the withdrawal step 103 of the punch holder 2 by movement of the punch holder 2 from its work position to its rest position along the axis of movement A.

As shown, in this position the punch holder 2 is between the work position and the rest position. In other words, it has left the work position and is moving toward the rest position. Here, the punch 3 is still housed in the hole that has just been made in the part T and is no longer in contact with the punch holder 2.

In other words, the punch holder 2 withdraws from its work position to its rest position and is moved away from the part T, the punch 3 being housed and held in the newly perforated hole in the part T.

It should be noted that the punching 102 of the part T can, for example, make it possible to make a hole of a diameter of between 6 and 10 mm. Larger or smaller holes can be made.

For example, such a hole can make it possible to insert a rivet or other means of fastening.

Figure 5:
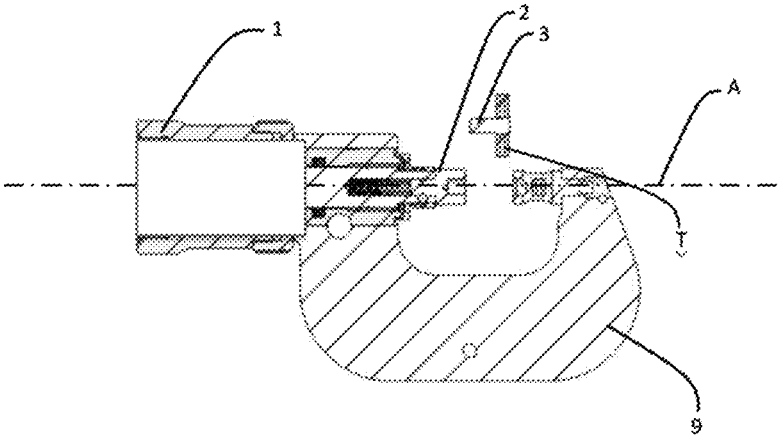
FIG. 5 is a cross-sectional view of the preceding punching tool, illustrating the step for releasing the sheet metal part.

FIG. 5 shows the release step 104 for releasing the part T once this part has been punched.

As shown in this position, the punch holder 2 is in the rest position at a distance from the part T, which is in turn released from the goose neck and is no longer resting against the punch die 4. The punch holder 2 and the punch die 4 are still aligned along the axis of movement A, whereas the punch 3 is still housed in the hole that has just been made in the part T.

Figure 6:
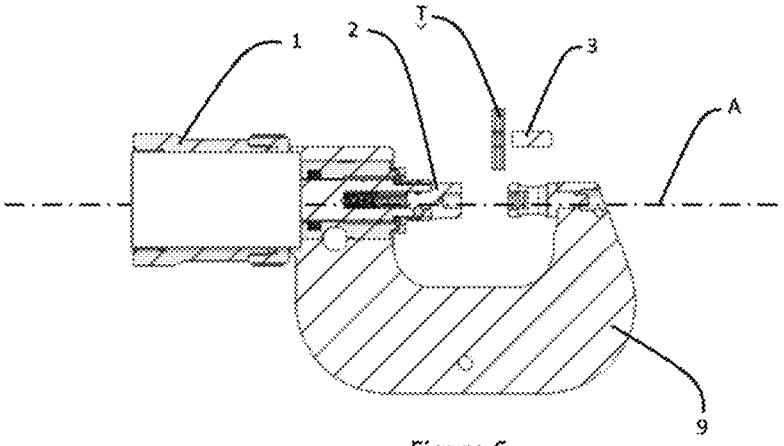
FIG. 6 is a cross-sectional view of the preceding punching tool, illustrating the step for removing the punch from the sheet metal part.

FIG. 6 shows the withdrawal step 105 for withdrawing the punch 3 from the part T.

As shown, the punch holder 2 is in the rest position at a distance from the part T, which is in turn released from the goose neck and is no longer resting against the punch die 4. The punch holder 2 and the punch die 4 are still aligned along the axis of movement A. The punch 3 can be released from the part T by being caused to pass through the hole in the perforating direction of the part T (that is, from left to right in the figures).

In other words, in this embodiment, and as shown in FIG. 6, the withdrawal step for withdrawing the punch 3 from the part T is completed by pushing the punch through the part T in the perforating direction of the hole.

In this way, by causing the punch 3 to pass through the hole in the perforating direction, that is, by not doing so in the opposite direction of perforation as in the prior art, the risks of deforming the edge of the hole, or the risks of getting the punch stuck in the hole, are avoided.

As shown in FIG. 7, the punching method can in addition comprise a prior step 106 for putting the punch 3 in place in the cavity 21 of the punch holder 2.

It should be noted that, according to the embodiments, this punch can be put in place before or after the punch holder is put in place on the goose neck, that is, before or after the part to be perforated has been placed in position between the punch holder and the die of the punching tool arranged in front of each other.

In addition, and as shown in this same FIG. 7, the punching method can furthermore comprise a prior step 106 of moving the part against punch die 4. It is possible for this part not to be placed against the punch die, but it will be pressed against the latter due to the advancing movement of the punch.

Furthermore, the punch may have a shape other than a cylindrical shape.

What is claimed is:

1. A punching tool to make a hole in a part made of a sheet metal or a multi-layer assembly of sheet metals, said punching tool comprising:

- a punch holder holding a one-piece reusable cutting punch capable of cutting the hole in the part made of a sheet metal or a multi-layer assembly of sheet metals; and
- a punch die facing said punch holder along an axis of movement, said punch holder being oriented to move said punch along the axis of movement in a perforating direction toward said die from a rest position to a work position in which said cutting punch cuts out the hole in said part placed between said punch holder and said die, said cutting punch being removably housed in a cavity formed in said punch holder so that, when said punch holder withdraws from the work position to the rest position in an opposite direction to the perforating direction, said cutting punch separates from said punch holder by translation and remains in the hole pierced in said part, wherein the cutting punch can be removed from the part by pushing the cutting punch through the hole in the perforating direction, such that the cutting punch can be re-installed to the punch holder for a next punching process.

2. The punching tool according to claim 1, wherein said cutting punch has an undercut and a tip, opposite said undercut, said tip being configured so as to slide into said cavity, said tip having a shape that complements that of said cavity.

3. The punching tool according to claim 2, wherein said tip of said cutting punch has a cylindrical shape.

4. A method of punching a part made of a sheet metal or a multi-layer assembly of sheet metals, wherein said method comprises the following series of steps:

positioning said part in a punching tool comprising:

a punch holder holding a one-piece reusable cutting punch capable of cutting a hole in the part made of a sheet metal or a multi-layer assembly of sheet metals; and a punch die facing said punch holder along an axis of movement, the part being positioned between the punch holder and the die, said punch holder being oriented to move said punch along the axis of movement in a perforating direction toward said die from a rest position to a work position in which said cutting punch cuts out the hole in said part placed between said punch holder and said die, said cutting punch being removably housed in a cavity formed in said punch holder so that, when said punch holder withdraws from the work position to the rest position in an opposite direction to the perforating direction, said cutting punch separates from said punch holder by translation and remains in the hole pierced in said part;

punching said part solely by the one-piece reusable cutting punch placed on the punch holder by moving the punch holder from the rest position to the work in the perforating direction;

moving the punch holder from the work position to the rest position in the opposite direction to the perforating direction;

releasing said part in which the cutting punch is housed;

removing said cutting punch from said part by pushing said cutting punch through the part along the axis of movement; and re-installing the cutting punch in position in the cavity of the punch holder for a next punching process.

5. The method of punching the part according to claim 4, wherein the step of removing said cutting punch from said part is performed by pushing said cutting punch through the part in the perforating direction of said hole.

6. The method of punching the part according to claim 4, wherein the method comprises a prior step of moving said part to be punched against said die.

* * * * *